United States Patent [19]

Guardamino

[11] 4,109,402

[45] Aug. 29, 1978

[54] DEVICE FOR REGULATING THE PRESSURE TO BE APPLIED TO THE TRIGGER ON FIREARMS

[76] Inventor: Inigo Diaz Guardamino, Avda. La Vega, 48 Guernica, Spain

[21] Appl. No.: 641,446

[22] Filed: Dec. 17, 1975

[30] Foreign Application Priority Data

Dec. 28, 1974 [ES] Spain ..... 208.736

[51] Int. Cl.[2] ..... F41C 19/00

[52] U.S. Cl. ..... 42/65; 42/69 R

[58] Field of Search ..... 42/65, 69 R, 69 B

[56] References Cited

U.S. PATENT DOCUMENTS

| | | | |
|---|---|---|---|
| 811,807 | 2/1906 | Wesson | 42/65 |
| 3,049,977 | 8/1962 | Reich | 42/65 |
| 3,176,423 | 4/1965 | Geber | 42/65 |
| 3,245,167 | 4/1966 | Freed | 42/65 |
| 3,965,603 | 6/1976 | Maillard | 42/65 |

*Primary Examiner*—Charles T. Jordan

*Attorney, Agent, or Firm*—Eyre, Mann, Lucas & Just

[57] ABSTRACT

A slide in a pistol applies force to the trigger. A spring is biased between the slide and a link member. The link member is screw-adjustable from outside the firearm in order to vary the pressure on the trigger. The link member is arranged to be non-rotating and has a hole therein. A hammer pushrod passes through the hole.

1 Claim, 5 Drawing Figures

DEVICE FOR REGULATING THE PRESSURE TO BE APPLIED TO THE TRIGGER ON FIREARMS

FIELD OF THE INVENTION

The present invention is concerned with the possibility of graduating the pressure or force which is required to be applied to the trigger of a revolver to make it fire.

DESCRIPTION OF THE PRIOR ART

When revolvers are not provided with any arrangement for adjusting the pull to be applied to the trigger upon firing, such pull will vary according to the accuracy with which each part of the firing mechanism has been machined to its proper dimensions; and this means that once the mechanism has been assembled, the trigger pull is constant, and can only be altered by changing the dimensions of some particular part, which entails disassembling it and touching it up.

Moreover, mechanisms of this type have the disadvantage that parts are subject to a greater or lesser degree of wear through their rubbing against each other during operation, and after a certain period of time this affects the amount of pull which needs to be applied to the trigger, in such a way that it differs from the pull which was initially needed to fire the revolver when it was new.

The only way to restore the original trigger pull in the firing mechanism is to follow the procedure of disassembly and touching up the parts as already described.

This consideration is of particular importance, because trigger pull values are subject to different rules and regulations. It is therefore advantageous to have an arrangement whereby they can be varied within certain maximum and minimum amounts.

DESCRIPTION OF THE PREFERRED EMBODIMENTS

To overcome the difficulties referred to above, it is proposed under the present invention to embody a part in the firing mechanism which, on the one hand, is to act as a stop for the spring in the slide piece actuated by the trigger, while on the other, it is to comprise a link with the housing of the butt, in such a way that the axial position of this part may be varied from the outside, and hence alter the degree with which it presses up against the spring. It is intended in this way for the spring pressure on the trigger to be adjusted from the outside without the need of disassembling the firing mechanism.

DESCRIPTION OF THE DRAWINGS

Embodiments of the invention will now be described by way of illustration with reference to the accompanying drawings showing a schematic arrangement of the device. Such schematic arrangements is in no way to be construed as imposing any limitations on the embodiment, and it may therefore be subject to those slight alterations which do not affect its essential features.

Referring especially to FIG. 1, this shows the external view of a pistol, in this particular case a revolver, equipped with the embodiment in question. Here the hammer or cocking handle is seen in the idle position, whence it is withdrawn when the pistol is cocked.

Figure 1:
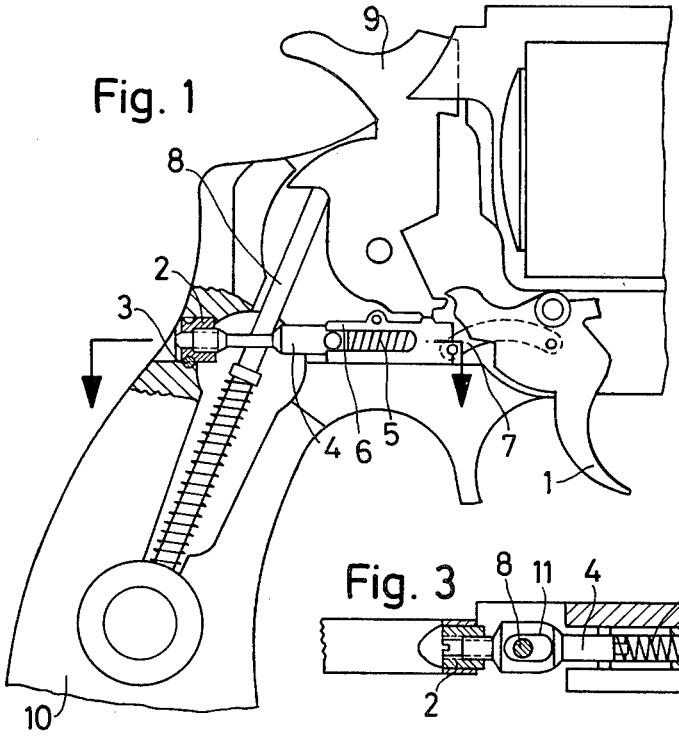
Figure 3:
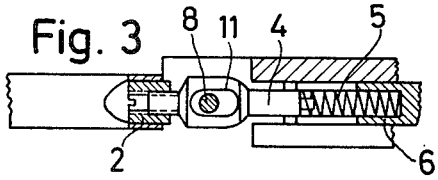
FIG. 3 is a detailed section on the plane shown in FIG. 1.
Figure 2:
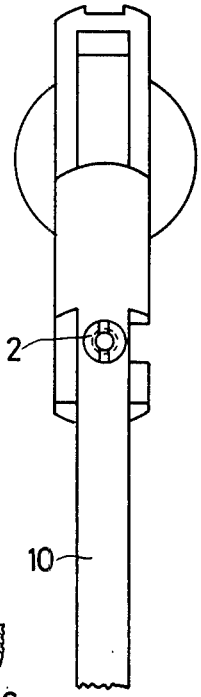
FIG. 2 is an end view.

Referring to these drawings, the trigger pressure regulating device in question here comprises a cylindrically shaped nut 2, which is housed in a hole provided for this purpose in the rear of the butt 10. The nut is prevented from rotating by the removable pin 3 which is likewise carried in a cylindrical housing in the butt 10, and attached thereto. The threaded centre hole in nut 2 engages with the thread on one end of linking piece 4, in such a way that according to how much nut 2 is rotated, after the pin 3 is removed linking piece 4 will move to a greater or lesser degree towards the right.

A gap 11 is provided in the middle of the link, to allow space for the rod 8 which presses against the hammer 9. The right hand end of the link houses and withstands the pressure from spring 5, whose opposite end is carried in slide piece 6.

In turn, slide piece 6 acts through link 7 against the trigger 1, exerting that force which must be overcome in order for the gun to be fired, and which it is intended to regulate by means of the present embodiment.

The further link 4 is moved towards the rear by means of turning nut 2, the greater will be the space wherein spring 5 can expand, so that the pressure required to actuate the trigger will be less. Conversely, if link 4 is moved forwards by rotation of nut 2 in the opposite direction, spring 5 will become compressed, so increasing the force required to trigger off the gun.

Figure 4:
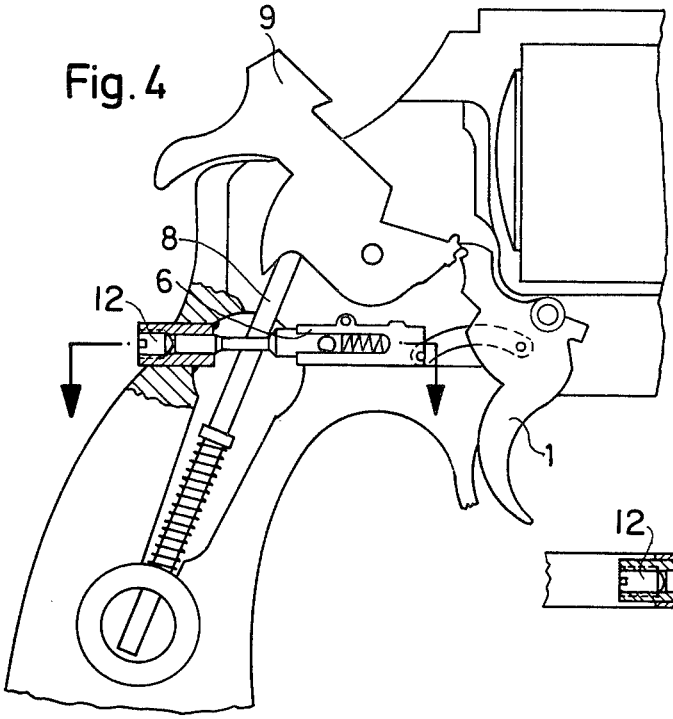
FIGS. 4 and 5 are respectively a side view and the plan view showing a variation in the embodiment, and the hammer can be seen to be raised and in the cocked position ready to fire when the trigger is pressed.
Figure 5:
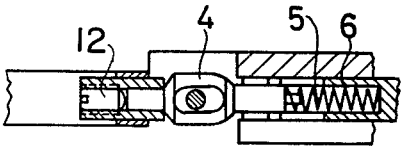

Link 4 can obviously be moved from one position to another by any other means, such as screw 12 engaging with the thread in a hole made for this purpose in the butt. Such threaded hole may be made in the actual butt of the pistol, or it may be a hole in an additional part attached to the butt afterwards, and neither alternative is to be construed as essentially altering the embodiment. See FIGS. 4 and 5.

DESCRIPTION OF OPERATION

If it is desired to increase the pull to be applied to the trigger, nut 2 is rotated in the direction which makes link 4 move towards the right, so as to compress spring 5 until the optimum amount of trigger pull is achieved. When it is desired to decrease the amount of trigger pull, nut 2 is turned in the opposite direction.

Should it not be required to have rod 8 going through the link, this would nevertheless be assembled as described, or it could be threaded directly to take the nut 2, and this alternative is comprised in the embodiment.

What is claimed is:

1. A device for regulating the pressure applied to a firing trigger of a fire-arm having a butt comprising a slide linked to said firing trigger, a spring having first and second ends, the first end of said spring bearing against said slide, a link member having first and second ends bearing at its first end against the second end of said spring, threaded means in said butt for moving said link member whereby said spring is compressed, said threaded means having means for permitting rotation thereof from outside said fire-arm, means on said slide for permitting it to move axially without turning, a hole in said link member, and a hammer pushrod passing through said hole.

* * * * *